US007223445B2

(12) United States Patent
Mehta et al.

(10) Patent No.: US 7,223,445 B2
(45) **Date of Patent: *May 29, 2007**

(54) PROCESS FOR THE DEPOSITION OF UNIFORM LAYER OF PARTICULATE MATERIAL

(75) Inventors: Rajesh V. Mehta, Rochester, NY (US); Ramesh Jagannathan, Rochester, NY (US); Seshadri Jagannathan, Pittsford, NY (US); Kelly S. Robinson, Fairport, NY (US); Karen L. Pond, Pittsford, NY (US); Bradley M. Houghtaling, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 270 days.

This patent is subject to a terminal disclaimer.

(21) Appl. No.: 10/815,026

(22) Filed: Mar. 31, 2004

(65) Prior Publication Data

US 2005/0221018 A1 Oct. 6, 2005

(51) Int. Cl.
*B05D 1/06* (2006.01)
*B05D 1/12* (2006.01)

(52) U.S. Cl. ..... 427/475; 427/180; 427/189; 427/195

(58) Field of Classification Search ..... 427/475, 427/180, 189, 195
See application file for complete search history.

(56) References Cited

U.S. PATENT DOCUMENTS 4,582,731 A 4/1986 Smith (Continued)

FOREIGN PATENT DOCUMENTS

EP 0 370 268 5/1990

(Continued)

OTHER PUBLICATIONS

Jean W. Tom et al; "Particle Formation With Supercritical Fluids-A Review"; Journal of Aerosol Science; vol. 22; No. 5; pp. 555-584; 1991.

(Continued)

*Primary Examiner*—Fred J. Parker
(74) *Attorney, Agent, or Firm*—Andrew J. Anderson

(57) ABSTRACT

A process for the deposition of particulate material of a desired substance on a surface includes: (i) charging a particle formation vessel with a compressed fluid; (ii) introducing into the particle formation vessel a first feed stream comprising a solvent and the desired substance dissolved therein and a second feed stream comprising the compressed fluid, wherein the desired substance is less soluble in the compressed fluid relative to its solubility in the solvent and the solvent is soluble in the compressed fluid, and wherein the first feed stream is dispersed in the compressed fluid, allowing extraction of the solvent into the compressed fluid and precipitation of particles of the desired substance; (iii) exhausting compressed fluid, solvent and the desired substance from the particle formation vessel at a rate substantially equal to the rate of addition of such components to the vessel in step (ii) through a restrictive passage to a lower pressure whereby the compressed fluid is transformed to a gaseous state and a flow of particles of the desired substance is formed; and (iv) exposing a receiver surface to the exhausted flow of particles of the desired substance and depositing a uniform layer of particles on the receiver surface.

17 Claims, 2 Drawing Sheets

U.S. PATENT DOCUMENTS

| | | | | |
|---|---|---|---|---|
| 4,734,227 | A | 3/1988 | Smith | |
| 4,734,451 | A | 3/1988 | Smith | |
| 4,737,384 | A | 4/1988 | Murthy et al. | |
| 4,923,720 | A | 5/1990 | Lee et al. | |
| 4,970,093 | A * | 11/1990 | Sievers et al. | 427/575 |
| 5,415,897 | A | 5/1995 | Chang et al. | |
| 5,639,441 | A | 6/1997 | Sievers et al. | |
| 5,707,634 | A | 1/1998 | Schmitt | |
| 5,851,453 | A | 12/1998 | Hanna et al. | |
| 6,221,435 | B1 | 4/2001 | Nielsen | |
| 6,440,337 | B1 | 8/2002 | Hanna et al. | |
| 6,471,327 | B2 | 10/2002 | Jagannathan et al. | |
| 6,575,721 | B1 | 6/2003 | Daly et al. | |
| 2002/0000681 | A1 | 1/2002 | Gupta et al. | |
| 2002/0015797 | A1 | 2/2002 | Hunt et al. | |
| 2003/0107614 | A1 | 6/2003 | Nelson et al. | |
| 2003/0132993 | A1 | 7/2003 | Sadasivan et al. | |
| 2003/0222019 | A1 * | 12/2003 | Fulton et al. | 210/634 |
| 2003/0227499 | A1 | 12/2003 | Sadasivan et al. | |
| 2003/0227502 | A1 | 12/2003 | Sadasivan et al. | |
| 2004/0063809 | A1 | 4/2004 | Fu et al. | |
| 2005/0218076 | A1 | 10/2005 | Mehta et al. | |
| 2005/0220994 | A1 | 10/2005 | Mehta et al. | |

FOREIGN PATENT DOCUMENTS

| | | | |
|---|---|---|---|
| EP | 0 473 424 | | 3/1992 |
| EP | 473 424 | * | 3/1992 |
| EP | 0 520 728 | | 12/1992 |
| EP | 1 236 519 | | 9/2002 |
| EP | 1 329 315 | | 7/2003 |
| EP | 1 391 944 | | 2/2004 |
| WO | 95/01221 | | 1/1995 |
| WO | 96/00610 | | 1/1996 |
| WO | 97/31691 | | 9/1997 |
| WO | 02/058674 | | 8/2002 |
| WO | 03/035673 | * | 5/2003 |

OTHER PUBLICATIONS

John L. Fulton et al; "Thin Fluoropolymer Films And Nanoparticle Coatings From The Rapid Expansion Of Supercritical Carbon Dioxide Solutions With Electrostatic Collection"; Polymer 44; 2003; pp. 3627-3632.

B. Helfgen et al; "Simulation Of Particle Formation During The Rapid Expansion Of Supercritical Solutions"; vol. 32; pp. 295-319; 2001.

"Strategies For Particle Design Using Supercritical Fluid Technologies"; of Peter York; Pharmaceutical Science & Technology Today; vol. 2; No. 11; Nov. 1999; pp. 430-440.

"Supercritical Antisolvent Precipitation of Micro- And Nano-Particles"; of Ernesto Reverchon; Journal of Supercritical Fluids; vol. 15; 1999; pp. 1-21.

"Particle Design Using Supercritical Fluids: Literature And Patent Survey"; of Jennifer Jung et al; Journal of Supercritical Fluids; vol. 20; 2001; pp. 179-219.

"Finely-Divided Powders By Carrier Solution Injection Into A Near Or Supercritical Fluid"; of William J. Schmitt et al; AIChE Journal; vol. 41; No. 11; Nov. 1995; pp. 2476-2486.

"Current Issues Relating To Anti-solvent Micronisation Techniques And Their Extension To Industrial Scales"; of Russel Thiering et al; Journal of Supercritical Fluids; vol. 21; 2001; pp. 159-177.

* cited by examiner

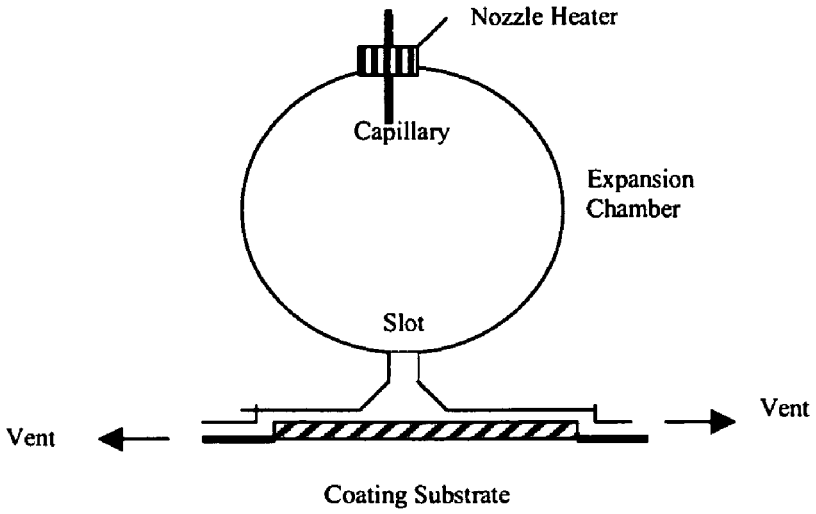
Fig. 1A
Fig. 1B
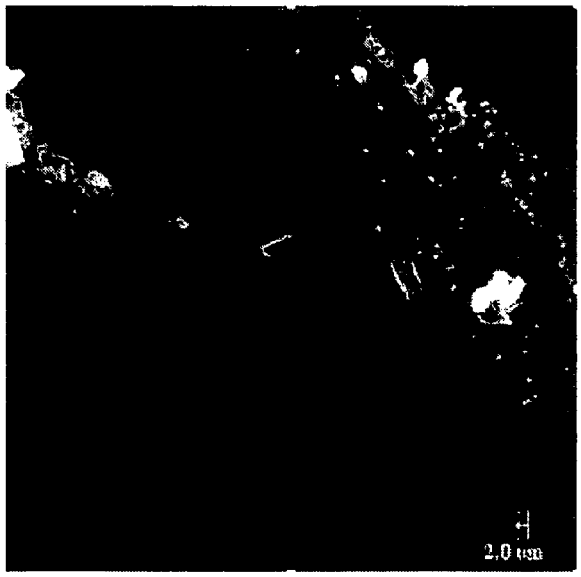

PROCESS FOR THE DEPOSITION OF UNIFORM LAYER OF PARTICULATE MATERIAL

FIELD OF THE INVENTION

This invention relates generally to deposition technologies, and more particularly, to a technology for delivering a flow of functional materials that are precipitated as liquid or solid particles into a compressed fluid that is in a supercritical or liquid state and becomes gaseous at ambient conditions, to create a uniform thin film onto a receiver.

BACKGROUND OF THE INVENTION

Deposition technologies are typically defined as technologies that deposit functional materials dissolved and/or dispersed in a fluid onto a receiver (also commonly known as substrate etc.). Technologies that use supercritical fluid solvents to create thin films are known. For example, R. D. Smith in U.S. Pat. Nos. 4,582,731, 4,734,227 and 4,743,451 discloses a method involving dissolution of a solid material into a supercritical fluid solution and then rapidly expanding the solution through a short orifice into a region of relatively low pressure to produce a molecular spray. This may be directed against a substrate to deposit a solid thin film thereon, or discharged into a collection chamber to collect a fine powder. By choosing appropriate geometry of the orifice, and maintenance of temperature, the method also allows making of ultra-thin fibers from polymers. This method is known as RESS (rapid expansion of supercritical solutions) in the art.

In general, a process is considered a RESS process when the functional material is dissolved or dispersed in a supercritical fluid or a mixture of supercritical fluid and a liquid solvent, or a mixture of a supercritical fluid and surfactant, or a combination of these, which is then rapidly expanded to cause simultaneous precipitation of the functional material. Tom, J. W. and Debenedetti, P. B. discuss RESS techniques in "Particle Formation with Supercritical Fluids—a Review," J. Aerosol. Sci. (1991) 22:555–584, and also their applications to inorganic, organic, pharmaceutical and polymeric materials. The RESS technique is useful to precipitate small particles of shock-sensitive solids, to produce intimate mixtures of amorphous materials, to form polymeric microspheres, and deposit thin films. One problem with RESS based thin film deposition technologies is that it is limited only to materials that are soluble in supercritical fluid. While it is known that co-solvents can improve the solubility of some materials, the class of materials that can be processed with RESS based thin film technologies is small. Another significant problem is that such technologies fundamentally rely on formation of functional material particles through sudden reduction of local pressure in the delivery system. While the reduced pressure reduces the solvent power of the supercritical fluid, and causes precipitation of the solute as fine particles, the control of the highly dynamic operative processes is inherently very difficult. When co-solvents are used in RESS, great care is required to prevent dissolution of the particles by condensing solvent in the nozzle or premature precipitation of particles and clogging in the nozzle. Helfgen et al., in "Simulation of particle formation during the rapid expansion of supercritical solutions", J. of Aerosol Science, 32, 295–319 (2001), discuss how the nucleation of particles upon supersonic free-jet expansion, and subsequent growth by coagulation at and beyond Mach disk, pose significant design challenges in controlling the particle characteristics. In addition, beyond the expansion device, the complex transonic flow of gaseous material must be managed such that the particles are deposited onto a surface and do not remain suspended in the expanded gas. This is dependent not only on fluid velocities but also on particle characteristics. A third problem pertains to the use of RESS methods in manufacturing: it is well recognized that progress to a fully continuous RESS process is limited by depletion of the stock solution to be expanded. Thus, there is a need for a technology that permits improved control of particle characteristics so that uniform thin films onto receiver surfaces can be deposited continuously with compressed carrier fluids for a broader class of materials.

Fulton et al. in "Thin fluropolymer films and nanoparticle coatings from the rapid expansion of supercritical carbon dioxide solutions with electrostatic collection", Polymer, 44, 3627–3632 (2003), describe a process that charges the homogeneously nucleated particle as they are formed with an electric field applied to the tip of the expansion nozzle. The charged particles are then forced to a solid surface in this field generating a uniform particle coating. This method, however, does not overcome the limitations of the RESS process, namely, control of particle characteristics, and its limited applicability to only materials soluble in supercritical fluid or its co-solvent mixture.

Sievers et al. U.S. Pat. No. 4,970,093 disclose a process for depositing a film on a substrate by rapidly releasing the pressure of a supercritical reaction mixture to form a vapor or aerosol that is not supercritical. A chemical reaction is induced in the vapor or aerosol so that a film of the desired material resulting from the chemical reaction is deposited on the substrate surface. Alternatively, the supercritical fluid contains a dissolved first reagent, which is contacted with a gas containing a second reagent, which reacts with the first reagent to form particles of the desired material deposited as a film on the substrate. In either case, the method still relies on particle formation upon expansion and suffers from the limited control of particle characteristics and only a narrow class of materials are suitable for processing by this method.

Hunt et al. U.S. 2002/0015797 A1 describe a method for chemical vapor deposition using a very fine atomization or vaporization of a reagent containing liquid or liquid-like fluid near its supercritical temperature by releasing it into a region of lower pressure, where the resulting atomized or vaporized solution is entered into a flame or a plasma torch, and a powder is formed or a coating is deposited onto a substrate. In this particular RESS process, rapid depressurization of a supercritical fluid creates an aerosol of liquid droplets. While further extending the number of possible usable precursors, this method does not improve the prior art in terms of particle characteristic control as particle nucleation and growth processes interact with the energetic regions of the combustion flame or plasma in an uncontrolled fashion.

Sievers et al. U.S. Pat. No. 5,639,441 describe an alternative RESS process and apparatus for forming fine particles of a desired substance upon expansion of a pressurized fluid, wherein the substance is first dissolved or suspended in a first fluid that is immiscible with the second fluid, which is then mixed with the second fluid that is preferably in its supercritical state, and the immiscible mixture is then reduced in pressure to form a gas-borne dispersion of liquid droplets. The method thus relies on atomization and coalescence of fluid droplets rather than nucleation and growth of particles in the supercritical fluid. It is essentially a RESS process as it seeks to make liquid particles through rapid expansion of supercritical fluids. The dispersion then is dried or heated to facilitate reactions to occur at or near surfaces to form coatings or fine particles. The particle formation in this process occurs well beyond the expansion region and occurs through mechanisms similar to those operative during conventional spray or film drying.

U.S. Pat. No. 4,737,384 to Murthy et al. describes a process for depositing a thin metal or polymer coating on a substrate by exposing the substrate at supercritical temperatures and pressures to a solution containing the metal or polymer in a solvent and reducing the pressure or temperature to sub-critical values to deposit a thin coating of the metal or polymer on the substrate. Since the process relies on particle and film formation upon the expansion of the supercritical solution, it is still a RESS process.

U.S. Pat. Nos. 4,923,720 and 6,221,435 disclose liquid coatings application process and apparatus in which supercritical fluids are used to reduce, to application consistency, viscous coatings compositions to allow for their application as liquid spray. The method comprises of a closed system and relies on decompressive atomization of liquid spray for the formation of a liquid coating. Once again, the method is a RESS process as it depends on rapid expansion of supercritical fluids to form liquid droplets.

U.S. Pat. No. 6,575,721 discloses system for continuous processing of powder coating compositions in which supercritical fluids are used to reduce, to application consistency, viscous coatings compositions to allow for their application at a lower temperature. While the method comprises of continuous processing, it still relies on rapid expansion of supercritical fluids to form liquid droplets that are spray dried, and thus, is a RESS process.

Thus, there is still a strong need for a compressed fluid based coating process that operates continuously, has improved control of particle formation for a broader class of materials than hitherto possible with RESS based processes, and can be used to coat these particles onto a substrate uniformly.

SUMMARY OF THE INVENTION

In accordance with one embodiment of the invention, a process for the deposition of particulate material of a desired substance on a surface is disclosed, the process comprising:

(i) charging a particle formation vessel, the temperature and pressure in which are controlled, with a compressed fluid;

(ii) introducing into the particle formation vessel at least a first feed stream comprising at least a solvent and the desired substance dissolved therein through a first feed stream introduction port and a second feed stream comprising the compressed fluid through a second feed stream introduction port, wherein the desired substance is less soluble in the compressed fluid relative to its solubility in the solvent and the solvent is soluble in the compressed fluid, and wherein the first feed stream is dispersed in the compressed fluid, allowing extraction of the solvent into the compressed fluid and precipitation of particles of the desired substance, (iii) exhausting compressed fluid, solvent and the desired substance from the particle formation vessel at a rate substantially equal to the rate of addition of such components to the vessel in step (ii) while maintaining temperature and pressure in the vessel at a desired constant level, such that formation of particulate material in the vessel occurs under essentially steady-state conditions, wherein the compressed fluid, solvent and the desired substance are exhausted from the particle formation vessel through a restrictive passage to a lower pressure whereby the compressed fluid is transformed to a gaseous state and a flow of particles of the desired substance is formed, and (iv) exposing a receiver surface to the exhausted flow of particles of the desired substance and depositing a uniform layer of particles on the receiver surface.

In accordance with various embodiments, the present invention provides technologies that permit functional material deposition of ultra-small particles; that permits high speed, accurate, and uniform deposition of a functional material on a receiver; that permits high speed, accurate, and precise patterning of a receiver that permits the creation of ultra-small features on the receiver when used in conjunction with a mask; that permits high speed, accurate, and precise coating of a receiver using a mixture of nanometer sized functional material dispersed in dense fluid and where the nanometer sized functional materials are continuously created; that permits high speed, accurate, and precise coating of a receiver using a mixture of nanometer sized materials of more than one functional material dispersed in dense fluid and where the nanometer sized functional materials are continuously created; that permits high speed, accurate, and precise coating of a receiver using a mixture of nanometer sized one or more functional material dispersed in dense fluid and where the nanometer sized functional materials are continuously created as a dispersion in the dense fluid in a vessel containing a mixing device or devices; and that permits high speed, accurate, and precise coating of a receiver that has improved material deposition capabilities.

BRIEF DESCRIPTION OF THE DRAWINGS

In the detailed description of the preferred embodiments of the invention presented below, reference is made to the accompanying figures, in which:

FIG. 1A: Schematic illustration of an expansion chamber and coating station employed in Example 1.

FIG. 1B: Scanning electron micrograph of coated surface obtained in Example 1.

DETAILED DESCRIPTION

Figure 2A:
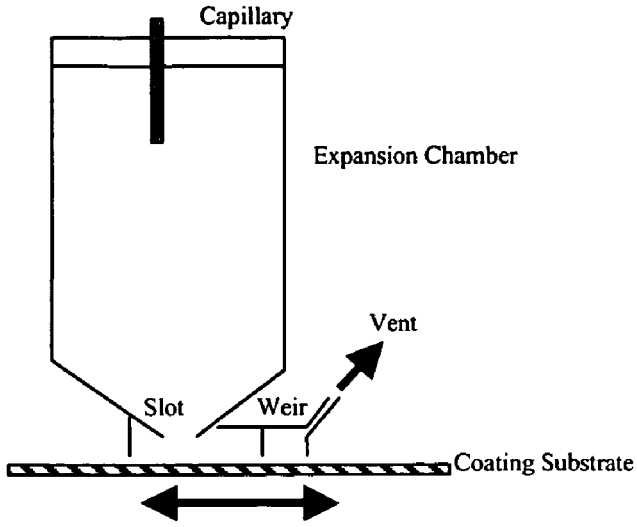
FIG. 2A: Schematic illustration of an expansion chamber and coating station employed in Example 2.

In accordance with this invention, it has been found that particles of a desired substance can be prepared under essentially steady state conditions by precipitation of the desired substance from a solution upon contact with a compressed fluid antisolvent in a particle formation vessel under conditions as described herein, exhausted from the vessel and coated on a surface to form a uniform layer. The process of the invention is applicable to the preparation of coatings of a wide variety of materials for use in, e.g., pharmaceutical, agricultural, food, chemical, imaging (including photographic and printing, and in particular inkjet printing), cosmetics, electronics (including electronic display device applications, and in particular color filter arrays and organic light emitting diode display devices), data recording, catalysts, polymer (including polymer filler applications), pesticides, explosives, and microstructure/nanostructure architecture building, all of which can benefit from use of continuous small particulate material coating processes. Materials of a desired substance precipitated and coated in accordance with the invention may be of the types such as organic, inorganic, metallo-organic, polymeric, oligomeric, metallic, alloy, ceramic, a synthetic and/or natural polymer, and a composite material of these previously mentioned. Precipitated and coated materials can be, for example colorants (including dyes and pigments), agricultural chemicals, commercial chemicals, fine chemicals, pharmaceutically useful compounds, food items, nutrients, pesticides, photographic chemicals, explosive, cosmetics, protective agents, metal coating precursor, or other industrial substances whose desired form is that of a deposited film or coating. Precipitated dyes and pigments are particularly preferred functional materials for use in coating applications in accordance with the invention.

The desired material to be precipitated and coated is first dissolved in a suitable liquid carrier solvent. As in known SAS type processes, solvents for use in the present invention may be selected based on ability to dissolve the desired material, miscibility with a compressed fluid antisolvent, toxicity, cost, and other factors. The solvent/solute solution is then contacted with a compressed fluid antisolvent in a particle formation vessel, the temperature and pressure in which are controlled, where the compressed fluid is selected based on its solubility with the solvent and relative insolubility of the desired particulate material (compared to its solubility in the solvent), so as to initiate precipitation of the solute from the solvent upon rapid extraction of the solvent into the compressed fluid. The functional material to be deposited in accordance with the inventive method a relatively higher solubility in the carrier solvent than in the compressed fluid or than in the mixture of compressed fluid and the carrier solvent. This enables the creation of a high supersaturation zone in the vicinity of the introduction point where the solution of functional material in the carrier solvent is added into the particle formation vessel. A wide variety of compressed fluids known in the art, and in particular supercritical fluids (e.g., $CO_2$, $NH_3$, $H_2O$, $N_2O$, ethane etc.), may be considered in such a selection, with supercritical $CO_2$ being generally preferred. Similarly, a wide variety of commonly used carrier solvents (e.g., ethanol, methanol, water, methylene chloride, acetone, toluene, dimethyl formamide, tetrahydrofuran, etc.) may be considered. Since, eventually both the compressed fluid and the carrier solvent are intended to be in the gaseous state, carrier solvents with higher volatility at lower temperatures are more desired. The relative solubility of functional material can also be adjusted by appropriate choice of pressure and temperature in the particle formation vessel.

Another requirement of the inventive process is that feed materials are adequately mixed with the vessel contents upon their introduction into the vessel, such that the carrier solvent and desired substance contained therein are dispersed in the compressed fluid, allowing extraction of the solvent into the compressed fluid and precipitation of particles of the desired substance. This mixing may be accomplished by the velocity of the flow at the introduction point, or through the impingement of feeds on to another or on a surface, or through provision of additional energy through devices such as a rotary mixer, or through ultrasonic vibration. It is important that the entire content of the particle formation vessel is maintained as close to a uniform concentration of particles as possible. The spatial zone of non-uniformity near the feed introduction should also be minimized. Inadequate mixing process may lead to an inferior control of particle characteristics. Thus, feed introduction into a region of high agitation, and the maintenance of a generally well-mixed bulk region is preferred.

In accordance with a preferred embodiment of the invention, the solvent/desired substance solution and compressed fluid antisolvent are contacted in a particle formation vessel by introducing feed streams of such components into a highly agitated zone of the particle formation vessel, such that the first solvent/solute feed stream is dispersed in the compressed fluid by action of a rotary agitator as described in concurrently filed, copending, commonly assigned U.S. Ser. No. 10/814,354, the disclosure of which is incorporated by reference herein. As described in such copending application, effective micro and meso mixing, and resulting intimate contact of the feed stream components, enabled by the introduction of the feed streams into the vessel within a distance of one impeller diameter from the surface of the impeller of the rotary agitator, enable precipitations of particles of the desired substance in the particle formation vessel with a volume-weighted average diameter of less than 100 nanometers, preferably less than 50 nanometers, and most preferably less than 10 nanometers. In addition, a narrow size-frequency distribution for the particles may be obtained. The measure of the volume-weighted size-frequency distribution, or coefficient of variation (mean diameter of the distribution divided by the standard deviation of the distribution), e.g., is typically 50% or less, with coefficients of variation of even less than 20% being enabled. The size-frequency distribution may therefore be monodisperse. Process conditions may be controlled in the particle formation vessel, and changed when desired, to vary particle size as desired. Preferred mixing apparatus which may be used in accordance with such embodiment includes rotary agitators of the type which have been previously disclosed for use in the photographic silver halide emulsion art for precipitating silver halide particles by reaction of simultaneously introduced silver and halide salt solution feed streams. Such rotary agitators may include, e.g., turbines, marine propellers, discs, and other mixing impellers known in the art (see, e.g., U.S. Pat. No. 3,415,650; U.S. Pat. No. 6,513,965, U.S. Pat. No. 6,422,736; U.S. Pat. No. 5,690,428, U.S. Pat. No. 5,334,359, U.S. Pat. No. 4,289,733; U.S. Pat. No. 5,096,690; U.S. Pat. No. 4,666,669, EP 1156875, WO-0160511).

While the specific configurations of the rotary agitators which may be employed in preferred embodiments of the invention may vary significantly, they preferably will each employ at least one impeller having a surface and a diameter, which impeller is effective in creating a highly agitated zone in the vicinity of the agitator. The term "highly agitated zone" describes a zone in the close proximity of the agitator within which a significant fraction of the power provided for mixing is dissipated by the material flow. Typically it is contained within a distance of one impeller diameter from a rotary impeller surface. Introduction of the compressed fluid antisolvent feed stream and solvent/solute feed stream into a particle formation vessel in close proximity to a rotary mixer, such that the feed streams are introduced into a relatively highly agitated zone created by the action of the rotary agitator provides for accomplishing meso-, micro-, and macro-mixing of the feed stream components to practically useful degrees. Depending on the processing fluid properties and the dynamic time scales of transfer or transformation processes associated with the particular compressed fluid, solvent and solute materials employed, the rotary agitator preferably employed may be selected to optimize meso-, micro-, and macro-mixing to varying practically useful degrees.

Mixing apparatus which may be employed in one particular embodiment of the invention includes mixing devices of the type disclosed in Research Disclosure, Vol. 382, February 1996, Item 38213. In such apparatus, means are provided for introducing feed streams from a remote source by conduits which terminate close to an adjacent inlet zone of the mixing device (less than one impeller diameter from the surface of the mixer impeller). To facilitate mixing of the feed streams, they are introduced in opposing direction in the vicinity of the inlet zone of the mixing device. The mixing device is vertically disposed in a reaction vessel, and attached to the end of a shaft driven at high speed by a suitable means, such as a motor. The lower end of the rotating mixing device is spaced up from the bottom of the reaction vessel, but beneath the surface of the fluid contained within the vessel. Baffles, sufficient in number of inhibit horizontal rotation of the contents of the vessel, may be located around the mixing device. Such mixing devices are also schematically depicted in U.S. Pat. Nos. 5,549,879 and 6,048,683, the disclosures of which are incorporated by reference.

Mixing apparatus which may be employed in another embodiment of the invention includes mixers which facilitate separate control of feed stream dispersion. (micromixing and mesomixing) and bulk circulation in the precipitation reactor (macromixing), such as descried in U.S. Pat. No. 6,422,736, the disclosure of which is incorporated by reference. Such apparatus comprises a vertically oriented draft tube, a bottom impeller positioned in the draft tube, and a top impeller positioned in the draft tube above the first impeller and spaced therefrom a distance sufficient for independent operation. The bottom impeller is preferably a flat blade turbine (FBT) and is used to efficiently disperse the feed streams, which are added at the bottom of the draft tube. The top impeller is preferably a pitched blade turbine (PBT) and is used to circulate the bulk fluid through the draft tube in an upward direction providing a narrow circulation time distribution through the reaction zone. Appropriate baffling may be used. The two impellers are placed at a distance such that independent operation is obtained. This independent operation and the simplicity of its geometry are features that make this mixer well suited in the scale-up of precipitation processes. Such apparatus provides intense micromixing, that is, it provides very high power dissipation in the region of feed stream introduction.

Rapid dispersal of the feed streams is important in controlling several factors, such as supersaturation caused by mixing of the solvent/solute with the compressed fluid antisolvent. The more intense the turbulent mixing is in the feed zone, the more rapidly the feed will be dissipated and mixed with the bulk. This is preferably accomplished using a flat bladed impeller and feeding the reagents directly into the discharge zone of the impeller. The flat bladed impeller possesses high shear and dissipation characteristics using the simplest design possible. The apparatus as descried in U.S. Pat. No. 6,422,736 also provides superior bulk circulation, or macromixing. Rapid homogenization rates and narrow circulation time distributions are desirable in achieving process uniformity. This is accomplished by employing an axial upward directed flow field, which is further enhanced by the use of a draft tube. This type of flow provides a single continuous circulation loop with no dead zones. In addition to directing fluid motion in an axial direction, the draft tube provides the means to run the impeller at much higher rpm, and confines the precipitation zone to the intensely mixed interior of the tube. To further stabilize the flow field, a disrupter device may be attached to the discharge of the draft tube, to reduce the rotational component of flow.

The use of a mixing device of the type described in U.S. Pat. No. 6,422,736 also provides a means for easily changing the power dissipation independently from the bulk circulation. This allows flexibility in choosing the mixing conditions that are optimal for the particular materials being used. This separation of bulk and hot zone mixing is accomplished by locating the pitched bladed impeller near the exit of the draft tube. The pitch bladed impeller provides a high flow to power ratio, which is easily varied, and is a simple design. It controls the rate of circulation through the draft tube, the rate being a function of the pitch angle of the blades, number and size of blades, etc. Because the pitch bladed impeller dissipates much less power than the flat bladed impeller, and is located sufficiently away from the feed point, the pitch bladed impeller does not interfere with the intensity of hot zone mixing in the draft tube, just the circulation rate through it. By placing the impellers a certain distance apart, this effect of independent mixing is maximized. The distance between the impellers also strongly affects the degree of back mixing in the hot zone, and hence provides yet another mixing parameter that can be varied. To further enable independent control of mixing parameters, the upper and lower impellers can have different diameters or operate at different speeds rather than the same speed. Also, the feed streams can be introduced by a multitude of tubes at various locations in the draft tube and with various orifice designs.

Another feature of the inventive process is that particle formation should occur continuously in the vicinity of the feed introduction points under essentially steady-state conditions. The physical characteristics of the formed particles, such as size, shape, crystallinity etc., may be suitably altered by the conditions that primarily determine the supersaturation level in the vicinity of the feed introduction points as well as in the remote regions of the vessel. A higher local supersaturation level near the feed introduction points would lead to smaller mean particle size. The relative residence times of the particles in these two regions of the vessel can also be employed to alter some of the characteristics of the particles.

Yet another feature of the inventive process is that the particles of functional material contained in the compressed fluid mixture need not be harvested on a filter, either inside or immediately downstream of the particle formation vessel, as is generally done in the conventional Supercritical Anti-Solvent (SAS) process, but rather are exhausted from the particle formation vessel while it is maintained under steady state conditions, and then are deposited on a surface to form a uniform coated layer. In the conventional SAS process, the presence of a filter designed primarily to harvest most of the particles formed in the particle formation vessel either requires installation of multiple filter elements in parallel, which increases manufacturing complexity, or requires interruption of the process to replace the plugged filter element in case of a single filter. The present process has no such limitations, which is highly advantageous.

Exhaustion of compressed fluid, solvent and the precipitated desired substance from the particle formation vessel through a restrictive passage, such as an expansion nozzle, leads to transformation of compressed fluid and the carrier solvent into their gas and vapor forms, while the functional material particles are entrained in the resultant exhausted flow stream. In a preferred embodiment, the compressed fluid, solvent and the desired substance are exhausted from the particle formation vessel by passage through a restrictive passage to an expansion chamber that is maintained at a desired lower pressure. The pressure and temperature in the expansion chamber are preferably maintained such that both the compressed fluid and the carrier solvent are substantially in their gas or vapor state upon expansion through an expansion nozzle. Depending on the intended applications, the expansion chamber pressures can range from several atmospheres to very high vacuum. The flow ensuing from the expansion nozzle is typically supersonic at prevailing conditions. During the expansion into the expansion chamber, or in a post-expansion stage, other forces such as fluid, electrical, magnetic and/or electromagnetic in nature, may modify the fluid mixture or the trajectory of its components.

In accordance with a specific embodiment, a partial-expansion chamber may also be employed in the restrictive passage flow path prior to the expansion nozzle to partially decrease the pressure from that of the particle formation vessel prior to the nozzle. This partial reduction in pressure can have many advantages which are not obtainable in a RESS process, where pressures upstream of the nozzle are fundamentally constrained in the design to be quite high. In the considered embodiment, this limitation is removed as the decrease in pressure in the partial-expansion chamber can be such that the fluid in the partial-expansion chamber is in supercritical, liquid or vapor state. A partial-expansion chamber can be used, e.g., to subject the fluid stream containing the precipitated particles to an external force field which are electrical, magnetic, sonic and any combination of those three forces, wherein the particles can be resident for a greater duration prior to passage through the expansion nozzle. In addition, the use of a functional material solvent such as acetone in the process of the invention provides a compressed fluid with greater conductivity than that typically obtained in RESS compressed fluid processes. As such, the efficiency of charge injection processes in either the particle formulation vessel or a partial-expansion chamber may be greatly increased. Charged particles offer the ability to increase material utilization efficiency and to enhance attachment of particles to a receiver.

Appropriately designed expansion nozzles are useful to facilitate the steady state operation of this process. The criticality of nozzle design, however, is substantially different compared to that in a conventional RESS process. This stems from the difference between managing a fluid stream that is undergoing a phase change (e.g., supercritical to non-supercritical) as well as precipitating the functional material (as in the case of RESS), compared to managing a fluid stream that is undergoing a phase change which already has dispersed solid or liquid particles formed therein (as is the case for the inventive process). While some functional material may also be in a dissolved state in the compressed fluid and may become available for growth of particles formed in the particle formation vessel, and/or may be available for formation of new particles when the compressed fluid is expanded into a chamber at lower pressure via a nozzle, the amount of such dissolved functional material is small relative to the amount of already precipitated material formed in the vessel. Thus, the formation of particles primarily in the particle formation vessel under steady state conditions is an advantage of this process. The additional possible option of employing a partial expansion chamber in the restrictive passage flow path prior to the expansion nozzle to partially decrease the pressure from that of the particle formation vessel prior to the nozzle as described above may also be used to simplify design of the nozzle relative to expansion nozzles employed in a RESS type process.

Many designs of expansion nozzles are known in the art which may be employed in the present invention, such as capillary nozzles, or orifice plates, or porous plug restrictors. Variants having converging or diverging profile of the nozzle passages, or combinations thereof, are also known. In general, heated nozzles provide a more stable operating window than non-heated nozzles. Improved control of particle characteristics in the inventive process is also a key to a relatively plugging-free operation of these nozzles. For uniform coating on moving substrates or uniform coating on a large area substrate, the use of flow distributor nozzles having either multiple openings or profiled slits is also envisioned.

The receiver surface to be coated is located downstream of the nozzle preferably at a distance determined experimentally to achieve the desired material deposition efficiency. Applications are envisioned where supersonic flow through an expansion nozzle is directly used for coating the functional material onto a receiver substrate. Additional electromagnetic or electrostatic means may also be used to interact with the nozzle exhaust to deflect the particles to the coating surface and/or to suppress their agglomeration. This includes electrostatic techniques such as induction, corona charging, charge injection or tribo-charging of particles for a more controlled deposition. Such electrostatic techniques may be employed, e.g., to increase the deposition rate of material, and to improve the surface uniformity of the deposited material. Material films deposited at ambient conditions of pressure and temperature, e.g., may be obtained with an average surface roughness of less than 10 nm, where the average surface roughness value is calculated by WYCO NT1000 as the arithmetic average of the absolute values of the surface features from the mean plane. Additional flow means may also be similarly employed to either control the momentum, or temperature, of the exhaust stream. The coating surface may also be either treated (uniformly or patterned) before or during deposition to enhance the particle deposition efficiency. For example, coating surface may be exposed to plasma or corona discharges to improve adhesion of depositing particles. Similarly, coating surfaces may be pre-patterned to have regions of relatively high or low conductivity (e.g., electrical, thermal, etc.), or regions of relatively high or low lyo- (e.g., hydro-, lipo-, oleo-, etc.) phobicity, or regions of relatively high or low permeability. Further, temperature of the deposition surface may be controlled to enhance the adhesion between layers of dissimilar materials or improve cohesion among layers of similar materials. In certain web coating applications or applications consisting of moving surfaces, more precise downstream applicator nozzles are also envisioned. The flow through these downstream applicator nozzles is preferably subsonic.

An additional feature for web or continuous coating applications is containment of the solvent vapors and particles that are not coated. This may be achieved by an enclosure that houses the coating station. Alternatively, a curtain of inert gases can also provide a sealing interface. Such an arrangement allows a highly compact apparatus for such applications. In certain applications, it may be advantageous to have additional post-coating processing capabilities such as heating or exposing to specific atmosphere. Similarly, multiple coating applicators may also be sequenced to create suitable multi-layer film architectures. A further aspect of manufacturing scale processes is recycling of processing fluids. This entails separation of carrier solvent vapors from the exhaust stream through condensation, a process that may also be used to trap and re-dissolve uncoated particles. The exhaust stream then could be recompressed and recycled as compressed fluid.

EXAMPLE 1

A nominally 1800 ml stainless steel particle formation vessel was fitted with a 4 cm diameter agitator of the type disclosed in U.S. Pat. No. 6,422,736, comprising a draft tube and bottom and top impellers. $CO_2$ was added to the particle formation vessel while adjusting temperature to 90 C and pressure to 300 bar and while stirring at 2775 revolutions per minute. The addition of $CO_2$ at 60 g/min through a feed port that had a 200 μm orifice at its tip, and a 0.1 wt % solution of Dye E and 0.01 wt % Cellulose Acetate Propionate binder (EASTMAN CAP 480-20) in acetone at 2 g/min, through a 100 μm tip, was then commenced, and the contents of the expansion chamber were exhausted from the chamber through an outlet port at an equivalent rate. The $CO_2$ and solution feed ports were located close to the bottom impeller as disclosed for the inlet tubes for the mixer in U.S. Pat. No. 6,422,736, such that both the solution and the $CO_2$ feed streams were introduced into a highly agitated zone within one impeller diameter of the bottom impeller. The molecular structure of Dye E was as follows:

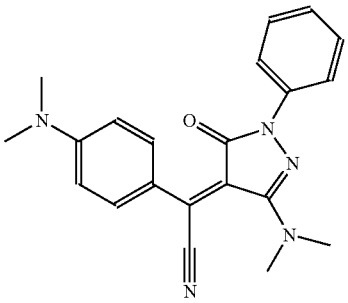

The outlet port of the particle formation vessel was connected to an automatic backpressure regulator. A protective stainless steel pre-filter, whose nominal filtration efficiency for 0.5 μm particles was 90%, was placed upstream of the backpressure regulator. A 5 cm long capillary, that was also heated to 90 C, served as the final restrictor before the compressed mixture expanded into a 10 cm diameter spherical expansion chamber that was at nominally atmospheric pressure. The expansion chamber (FIG. 1A) had a cylindrical slot (1.5 cm diameter and 3 cm long) that was flared to 6 cm diameter over a height of 3.5 cm to facilitate coating of the exhausted material onto a surface below. The coating surface was kept 18 cm away from the tip of the capillary.

After the system reached steady state conditions of temperature and pressure in the particle formation vessel and also in the expansion chamber, a 4" diameter silicon wafer was placed on the coating surface. Deposition of dye and binder material exhausted from the particle formation vessel was continued for 15 min and then the wafer was removed. FIG. 1B shows a scanning electron micrograph of the wafer surface after it was carefully scratched. A uniform and continuous film of the dye and binder is evident as the curled up object peeled back from the scratch near the upper left corner of the figure.

EXAMPLE 2

A nominally 1800 ml stainless steel particle formation vessel was fitted with a 4 cm diameter agitator of the type disclosed in U.S. Pat. No. 6,422,736, comprising a draft tube and bottom and top impellers. $CO_2$ was added to the particle formation vessel while adjusting temperature to 90 C and pressure to 300 bar and while stirring at 2775 revolutions per minute. The addition of $CO_2$ at 40 g/min through a feed port that had a 200 μm orifice at its tip, and a 0.1 wt % solution of Tert-Butyl-anthracene di-naphthylene (TBADN: a functional material used in Organic Light Emitting Diodes) in acetone at 2 g/min, through a 100 μm tip, was then commenced, and the contents of the expansion chamber were exhausted from the chamber through an outlet port at an equivalent rate. The $CO_2$ and solution feed ports were located close to the bottom impeller as disclosed for the inlet tubes for the mixer in U.S. Pat. No. 6,422,736, such that both the solution and the $CO_2$ feed streams were introduced into a highly agitated zone within one impeller diameter of the bottom impeller. The molecular structure of TBADN is as follows:

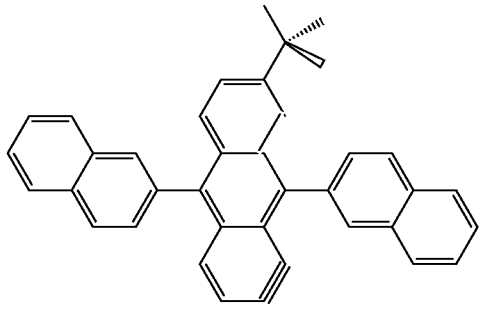

The outlet port of the particle formation vessel was connected to an automatic backpressure regulator. A stainless steel pre-filter, whose nominal filtration efficiency for 0.5 μm particles was 90%, was placed upstream of the backpressure regulator. The output of the regulator was connected to a pre-expansion heater that heated the flow to 90 C before sending it to an expansion chamber at nominally atmospheric pressure. A 0.01" inner diameter capillary that was 3.25" long, served as the final restrictor before the compressed mixture expanded into the chamber. The expansion chamber (FIG. 2A) was cylindrical and had an inside diameter of 14 cm. A coating substrate was kept 51 cm away from the tip of the capillary. The expansion chamber was shaped with a 1.9 cm wide rectangular slot at the end of the chamber remote from the capillary. The coating substrate could be moved back and forth under the slot at predetermined speed. The flow of exhausted material moved nominally parallel to the substrate after the impingement, passed under a weir that had a gap of about 203 μm from the substrate, and then went to a vent that had a low level of suction to aid the flow. The entire coating station was also enclosed in an airtight enclosure (not shown).

Figure 2B:
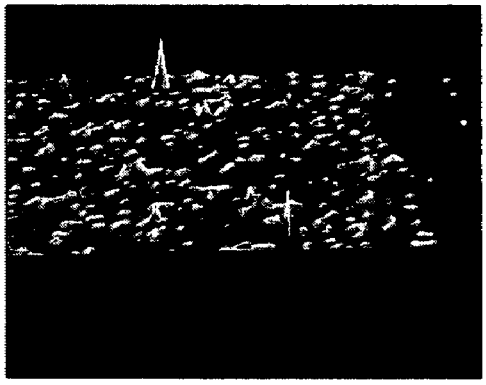
FIG. 2B: Surface profile representation for coated surface obtained in Example 2 obtained by Vertical Scanning Interferometry.
Figure 2C:
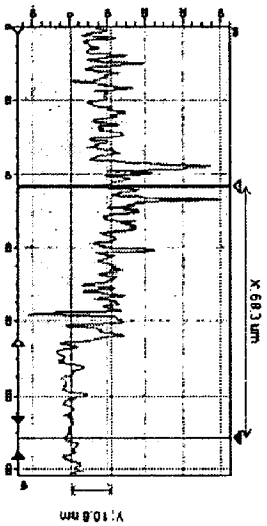
FIG. 2C: Graph illustrating surface height profile for coated surface obtained in Example 2.

After the system reached steady state conditions of temperature and pressure in the particle formation vessel and also in the expansion chamber, a 2"×2" laboratory glass slide was placed on the coating surface. The surface was passed 10 times under the coating slot at a speed of 0.05 ft/min. The slide was then examined by Vertical Scanning Interferometry with a non-contact optical profilometer (WYCO NT1000 from Veeco Instruments) at a surface magnification of 50×. FIG. 2(B) shows the topography of the deposited layer over a horizontal distance of 120 μm. FIG. 2(C) indicates a nominal layer thickness of 10.6 nm, and a continuous film.

EXAMPLE 3

Figure 3:
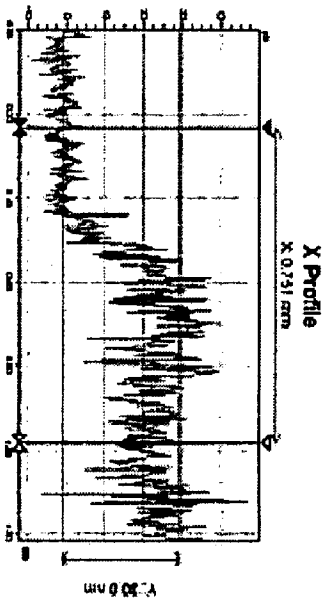
FIG. 3: Graph illustrating surface height profile for coated surface obtained in Example 3.

The procedure employed in Example 2 was repeated, except the functional material concentration was 0.05 wt % in acetone and the pre-expansion heater temperature was 180 C. The resulting coating on the glass slide was also similarly examined, but at a surface magnification of 100×. FIG. 3 shows the instrument signal near a carefully created edge on the deposition surface. The lower level of the signal corresponds to the bare surface. The higher level corresponds to the deposited layer. It shows a nominal layer thickness of 30 nm, and a layer that is also continuous. The average surface roughness of the 30 nm thick layer was 5.44 nm, calculated by WYCO NT1000 as the arithmetic average of the absolute values of the surface features from the mean plane.

EXAMPLE 4

The experimental apparatus used in Example 1 was modified as follows and then used: a 0.64 cm thick disc was added to the flared portion of the bottom of the expansion chamber. The disc had a 2.78 cm long and 0.64 cm wide slot along its diameter. A 100 μm diameter Tungsten wire was mounted in that slot such that the wire was nominally 0.95 cm away from the coating substrate. The Tungsten wire was connected to a high voltage power supply with 11 MΩ resistor. The coating substrate was also grounded.

$CO_2$ was added to the particle formation vessel while adjusting temperature to 90 C and pressure to 300 bar and while stirring at 2775 revolutions per minute. The addition of $CO_2$ at 60 g/min and a 0.2 wt % solution of TBADN in acetone at 2 g/min was then commenced. The temperature of the capillary nozzle feeding into the expansion chamber was set at 90 C. After the system reached steady state conditions of temperature and pressure in the particle formation vessel and also in the expansion chamber, a 4" diameter silicon wafer was placed on the coating surface. The Tungsten wire was applied a DC voltage of +12 kV for 10 seconds and then the coated wafer was removed for film thickness analysis by Vertical Scanning Interferometry. Evaluations were made in 4 areas, each one successively further from the wire location in the center of the sample: Area A was closest to the wire, Area D was the most distant. The results were as follows:

| | |
|---|---|
| Area (A) | 1.1–1.5 μm |
| Area (B) | 115 nm |
| Area (C) | 40 nm |
| Area (D) | 18 nm |

Compared to film thickness obtained in Example 2&3 and those observed in more distant areas from the wire (C&D), the results suggest that conventional DC corona charging is effective in dramatically improving the deposition rate.

EXAMPLE 5

The experimental set-up and procedures used in Example 4 were repeated with the following differences: A 15 kV peak-to-peak AC voltage was applied to the corona wire and the deposition time was 5 min. Vertical Scanning Interferometric results from two areas on the wafer were as follows:

| | |
|---|---|
| Area (A) | 111 nm |
| Area (B) | 45 nm |

The results suggest that conventional electrostatic charging techniques like AC corona also can be usefully employed to improve the deposition rate.

The invention claimed is:

1. A process for the deposition of particulate material of a desired substance on a surface is disclosed, the process comprising:

(i) charging a particle formation vessel, the temperature and pressure in which are controlled, with a compressed fluid;

(ii) introducing into the particle formation vessel at least a first feed stream comprising at least a solvent and the desired substance dissolved therein through a first feed stream introduction port and a second feed stream comprising the compressed fluid through a second feed stream introduction port, wherein the desired substance is less soluble in the compressed fluid relative to its solubility in the solvent and the solvent is soluble in the compressed fluid, and wherein the first feed stream is dispersed in the compressed fluid, allowing extraction of the solvent into the compressed fluid and precipitation of particles of the desired substance, (iii) exhausting compressed fluid, solvent and the desired substance from the particle formation vessel at a rate substantially equal to the rate of addition of such components to the vessel in step (ii) while maintaining temperature and pressure in the vessel at a desired constant level, such that formation of particulate material in the vessel occurs under essentially steady-state conditions, wherein the compressed fluid, solvent and the desired substance are exhausted from the particle formation vessel through a restrictive passage to a lower pressure whereby the compressed fluid is transformed to a gaseous state and a flow of particles of the desired substance is formed, and (iv) exposing a receiver surface to the exhausted flow of particles of the desired substance and depositing a uniform layer of particles on the receiver surface.

2. A process according to claim 1, wherein the compressed fluid comprises a supercritical fluid.

3. A process according to claim 2, wherein the supercritical fluid, solvent and desired substance are exhausted from the particle formation vessel by passage to an expansion chamber, and where the exhausted flow of particles of the desired substance is then directed from the expansion chamber to the receiver surface to deposit the uniform layer of particles on the receiver surface.

4. A process according to claim 1, wherein particles of the desired substance are precipitating in the particle formation vessel with a volume-weighted average diameter of less than 100 nanometers.

5. A process according to claim 4, wherein the coefficient of variation of the particle size distribution of the particles of the desired substance precipitated in the particle formation vessel is less than 50%.

6. A process according to claim 5, wherein the coefficient of variation of the particle size distribution of the particles of the desired substance precipitated in the particle formation vessel is less than 20%.

7. A process according to claim 1, wherein particles of the desired substance are precipitating in the particle formation vessel with a volume-weighted average diameter of less than 50 nanometers.

8. A process according to claim 1, wherein particles of the desired substance are precipitating in the particle formation vessel with a volume-weighted average diameter of less than 10 nanometers.

9. A process according to claim 1, wherein contents of the particle formation vessel are agitated with a rotary agitator comprising an impeller having an impeller surface and an impeller diameter, creating a relatively highly agitated zone located within a distance of one impeller diameter from the surface of the impeller of the rotary agitator, and a bulk mixing zone located at distances greater than one impeller diameter from the surface of the impeller, and wherein the first and second feed stream introduction ports are located within a distance of one impeller diameter from the surface of the impeller of the rotary agitator such that the first and second feed streams are introduced into the highly agitated zone of the particle formation vessel and the first feed stream is dispersed in the supercritical fluid by action of the rotary agitator.

10. A process according to claim 1, where the uniform layer deposited in step (iv) is a continuous film.

11. A process according to claim 1, where the desired substance deposited in step (iv) comprises a colorant in a polymeric binder.

12. A process according to claim 11, wherein the colorant comprises a dye.

13. A process according to claim 1, where the desired substance comprises a compound used to make organic electroluminescent devices.

14. A process according to claim 1, further comprising controlling deposition of particles in step (iv) with induction-, corona-, injection- or tribo-charging.

15. A process according to claim 14, wherein the induction-, corona-, injection- or tribo-charging increases the rate of deposition of the particles.

16. A process according to claim 14 in which the film is generated at ambient conditions of pressure and temperature and has but has an average surface roughness of less than 10 nm, calculated by WYCO NT1000 as the arithmetic average of the absolute values of the surface features from the mean plane.

17. A process according to claim 1, wherein the restrictive passage includes a partial-expansion chamber, in which the pressure of the compressed fluid, solvent and the desired substance exhausted from the particle formation vessel is partially decreased prior to passage through an expansion nozzle.

* * * * *